US012313367B2

(12) United States Patent
Zheng

(10) Patent No.: US 12,313,367 B2
(45) Date of Patent: May 27, 2025

(54) ADJUSTABLE GAS BLOCK WITH FRONT ADJUSTMENT ACCESS FOR FIREARM DIRECT-IMPINGEMENT GAS SYSTEM

(71) Applicant: Jing Zheng, Chesterfield, VA (US)

(72) Inventor: Jing Zheng, Chesterfield, VA (US)

( * ) Notice: Subject to any disclaimer, the term of this patent is extended or adjusted under 35 U.S.C. 154(b) by 0 days.

(21) Appl. No.: 18/244,769

(22) Filed: Sep. 11, 2023

(65) Prior Publication Data

US 2024/0085129 A1 Mar. 14, 2024

Related U.S. Application Data

(60) Provisional application No. 63/405,545, filed on Sep. 12, 2022.

(51) Int. Cl.
*F41A 5/28* (2006.01)

(52) U.S. Cl.
CPC ..... *F41A 5/28* (2013.01)

(58) Field of Classification Search
CPC ..... F41A 5/26; F41A 5/28
USPC ..... 89/193
See application file for complete search history.

(56) References Cited

U.S. PATENT DOCUMENTS 4,125,054 A * 11/1978 Jennie ..... F41A 5/28 89/193
7,694,619 B2 * 4/2010 Beretta ..... F41A 21/28 89/14.3
8,960,069 B1 * 2/2015 Soong ..... F41A 5/28 89/193
2012/0131834 A1 * 5/2012 Barrett ..... F41A 5/28 42/75.02
2012/0167756 A1 * 7/2012 Larue ..... F41A 21/28 89/193
2012/0317860 A1 * 12/2012 Langevin ..... F41A 5/28 42/111
2013/0269510 A1 * 10/2013 Sullivan ..... F41A 5/28 89/193
2014/0076150 A1 * 3/2014 Brinkmeyer ..... F41A 5/28 89/193
2014/0083286 A1 * 3/2014 Gomez ..... F41A 5/18 89/193
2015/0184960 A1 * 7/2015 Monveldt ..... F41A 5/26 89/193
2016/0109200 A1 * 4/2016 Gomez ..... F41G 1/02 89/193
2016/0245603 A1 * 8/2016 Pizano ..... F41A 5/26
2018/0180370 A1 * 6/2018 Zheng ..... F41A 5/28
(Continued)

*Primary Examiner* — Joshua E Freeman
*Assistant Examiner* — Benjamin S Gomberg
(74) *Attorney, Agent, or Firm* — Andy M. Han; Han IP PLLC

(57) ABSTRACT

An adjustable gas system for a firearm includes a one-piece gas block body, configured to be fixed to a barrel of the firearm, and a partial annular gas regulator. The gas block includes a gas flow hole that receives a gas tube of the firearm. The gas block body also includes a gas block body bulge and a ring at one end of the gas flow hole. The gas block body clamps to a barrel of the firearm by: (i) set screw(s), and (ii) direct/physical contact of the gas block body bulge and the ring. The gas regulator, when installed on the barrel, rotatably and partially surrounds the barrel such that, as the gas regulator is rotated around the barrel from a first position to a second position, a diameter of a resultant gas port hole changes as controlled by allocation holes on the gas regulator.

1 Claim, 4 Drawing Sheets

(56) References Cited

U.S. PATENT DOCUMENTS

| | | | | |
|---|---|---|---|---|
| 2018/0202733 | A1* | 7/2018 | Bray | F41A 5/28 |
| 2020/0025476 | A1* | 1/2020 | Aubin | F41A 5/26 |
| 2021/0055067 | A1* | 2/2021 | Nguyen | F41A 5/28 |
| 2022/0364807 | A1* | 11/2022 | Kroyer | F41A 5/28 |
| 2023/0228507 | A1* | 7/2023 | Fisher | F41A 5/26 89/193 |

* cited by examiner

ADJUSTABLE GAS BLOCK WITH FRONT ADJUSTMENT ACCESS FOR FIREARM DIRECT-IMPINGEMENT GAS SYSTEM

CROSS REFERENCE TO RELATED PATENT APPLICATION(S)

The present disclosure claims the priority benefit of U.S. Provisional Patent Application No. 63/405,545, filed 12 Sep. 2022, the content of which herein being incorporated by reference in its entirety.

TECHNICAL FIELD

The present disclosure generally relates to firearms. More specifically, the present disclosure relates to an adjustable gas block with a front, around the barrel adjustment access for a direct-impingement gas system on firearms.

BACKGROUND

The term "gas-operation system" in the context of firearms generally refers to a system of operation used to provide energy to operate auto-loading firearms. In gas-operation, a portion of high pressure gas from the cartridge being fired is used to power a mechanism to perform the following operations: (1) extracting the spent casing, and (2) chambering a new cartridge. For example, in a firearm based on the AR-15 platform, there is usually a small gas port, or small hole, in the barrel that vents gas with every shot. In a "direct impingement" (DI) gas system, the vented gas travels through a gas block and gas tube into the receiver, where the gas powers the bolt carrier group (BCG) and auto-cycles the next round. In a "piston-operated" or "piston-stroke" system, the vented gas acts upon a face of a piston, which in turn moves the BCG to extract the spent casing and chamber a new cartridge.

Usually, the gas system is tuned to one specific ammunition of certain caliber to work the best in a typical environmental condition and certain firearm configuration. This is what is called a fixed gas system. The advantage of this system is that it is light weight, has fewer parts, and is very reliable if the working condition and firearm configuration are correct. A typical example of such system is on AR-15 rifles, a civilian variant of the military version of M16/M4 rifle. However, as environmental condition changes and/or as the firearm configuration changes, or simply because the firearm is not assembled right, the firearm could experience what is called an over-gas situation or an under-gas situation.

The over-gas situation tends to happen when the firearm is used in conjunction with a silencer, or some kind of recoil reduction muzzle device, such that the back pressure generated by such device would add the gas pressure to the gas system. As such, the bolt carrier group tends to move back faster with more energy. Given a weak extractor spring, the extractor may run over the rim of the spent casing and leave it stuck inside the chamber, thus resulting in jamming the firearm, when the BCG travels back and reloads the next round. Moreover, a so-called "felt recoil" may result, and the firearm may be put under more stress and hence its service life may be shortened.

The under-gas situation tends to happen when the firearm gets dirty, or when the environment is very cold such that the system does not have enough gas energy to recycle the firearm. As such, the BCG either may not move back enough to either eject the spent casing or may fail to load the next round, thus resulting in jamming the firearm. Moreover, in existing designs, access to a gas block body is typically on the side of the gas block, or on the front of the gas block but over the barrel, or from the back of the gas block and around the barrel, but these designs tend to make it difficult to access or otherwise requires the use of a tool to make adjust gas pressure.

SUMMARY

The present disclosure proposes a novel design of an adjustable gas system with a new body and an adjustor design such that an access point of adjustment (by a user) is moved from the back of the gas block body to the front thereof, and around the barrel, thereby making it possible for the user to make adjustment directly with hand from the muzzle position.

Under various proposed schemes in accordance with the present disclosure, an adjustable gas system for a firearm may include a one-piece gas block body, configured to be fixed to a barrel of the firearm, and a partial annular gas regulator. The gas block may include a gas flow hole that receives a gas tube of the firearm. The gas block body may also include a gas block body bulge and a ring at one end of the gas flow hole. The gas block body may be configured to clamp to a barrel of the firearm by: (i) one or more set screws, and (ii) direct/physical contact of the gas block body bulge and the ring. The gas regulator, when installed on the barrel, may be configured to rotatably and partially surround the barrel such that, as the gas regulator is rotated around the barrel from a first position to a second position, a diameter of a resultant gas port hole changes from a first size to a second size (different from the first size) as controlled by a plurality of allocation holes on the gas regulator.

These and other objectives of the present disclosure will be appreciated by those of ordinary skill in the art after reading the following detailed description of the preferred embodiments that are illustrated in the various figures and drawings.

BRIEF DESCRIPTION OF THE DRAWINGS

The accompanying drawings are included to provide a further understanding of the disclosure, and are incorporated in and constitute a part of the present disclosure. The drawings illustrate embodiments of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF THE PREFERRED EMBODIMENTS

Overview

Figure 1:
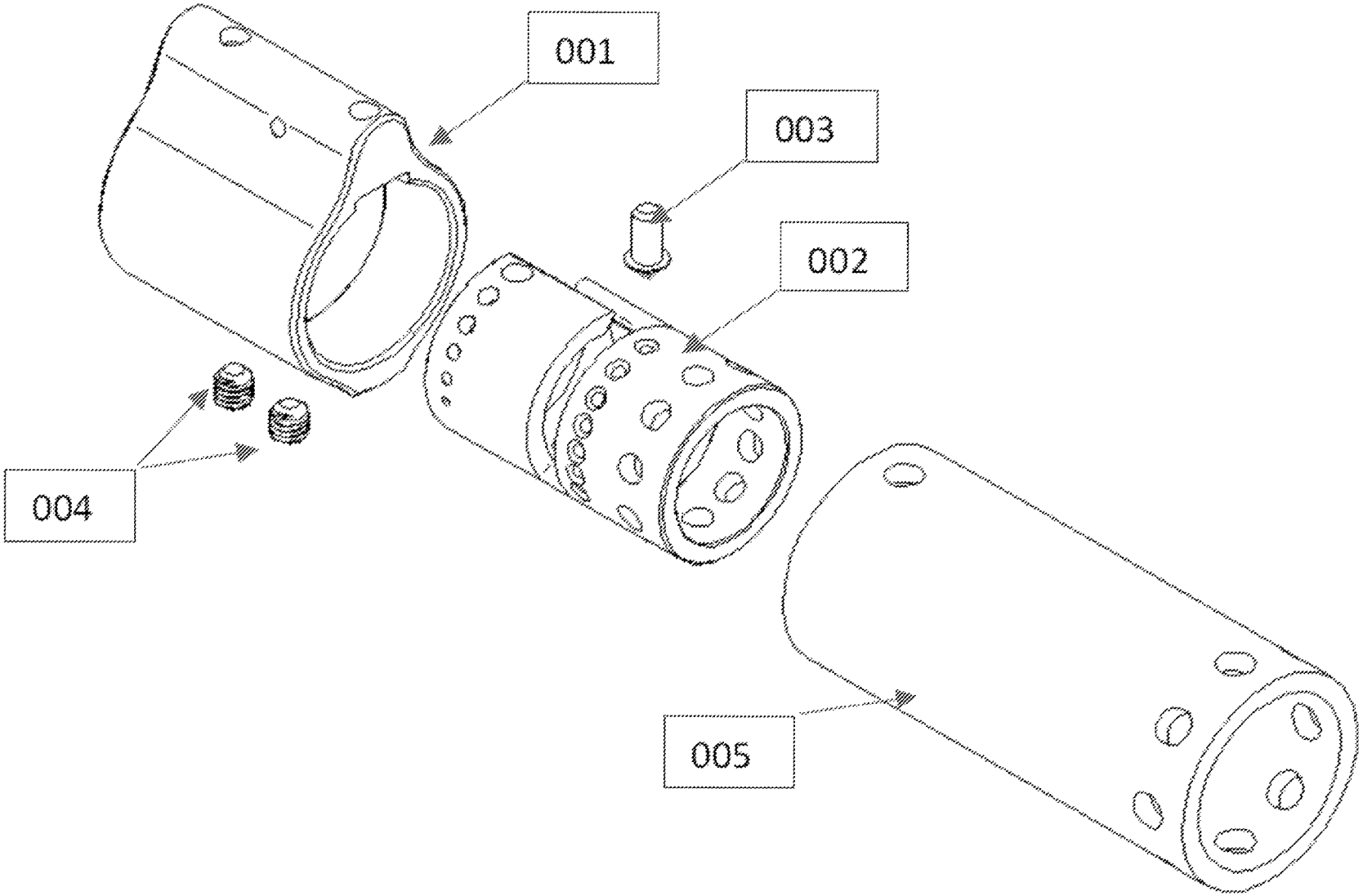
FIG. 1 is a diagram of an exploded view of an adjustable gas system in accordance with the present disclosure.

Various embodiments of the present disclosure relate to an adjustable gas system for firearms. The proposed design utilizes a set of different sized holes to allow different amounts of gas to move the BCG in an optimum speed and achieve optimum amount of backward displacement.

Reference will now be made in detail to the preferred embodiments of the present disclosure, examples of which are illustrated in the accompanying drawings. Wherever possible, the same reference numbers are used in the drawings and the description to refer to the same or like parts.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator of the firearm. The same convention applies for the direction statements used herein.

Referring to FIG. 1, an adjustable gas system under a proposed scheme in accordance with the present disclosure may include a Gas Block Body 001, a Gas Regulator 002, a Spring Plunger 003, and two Set Screws 004. Optionally, adjustable gas system may also include a Regulator Extension 005.

Figure 2:
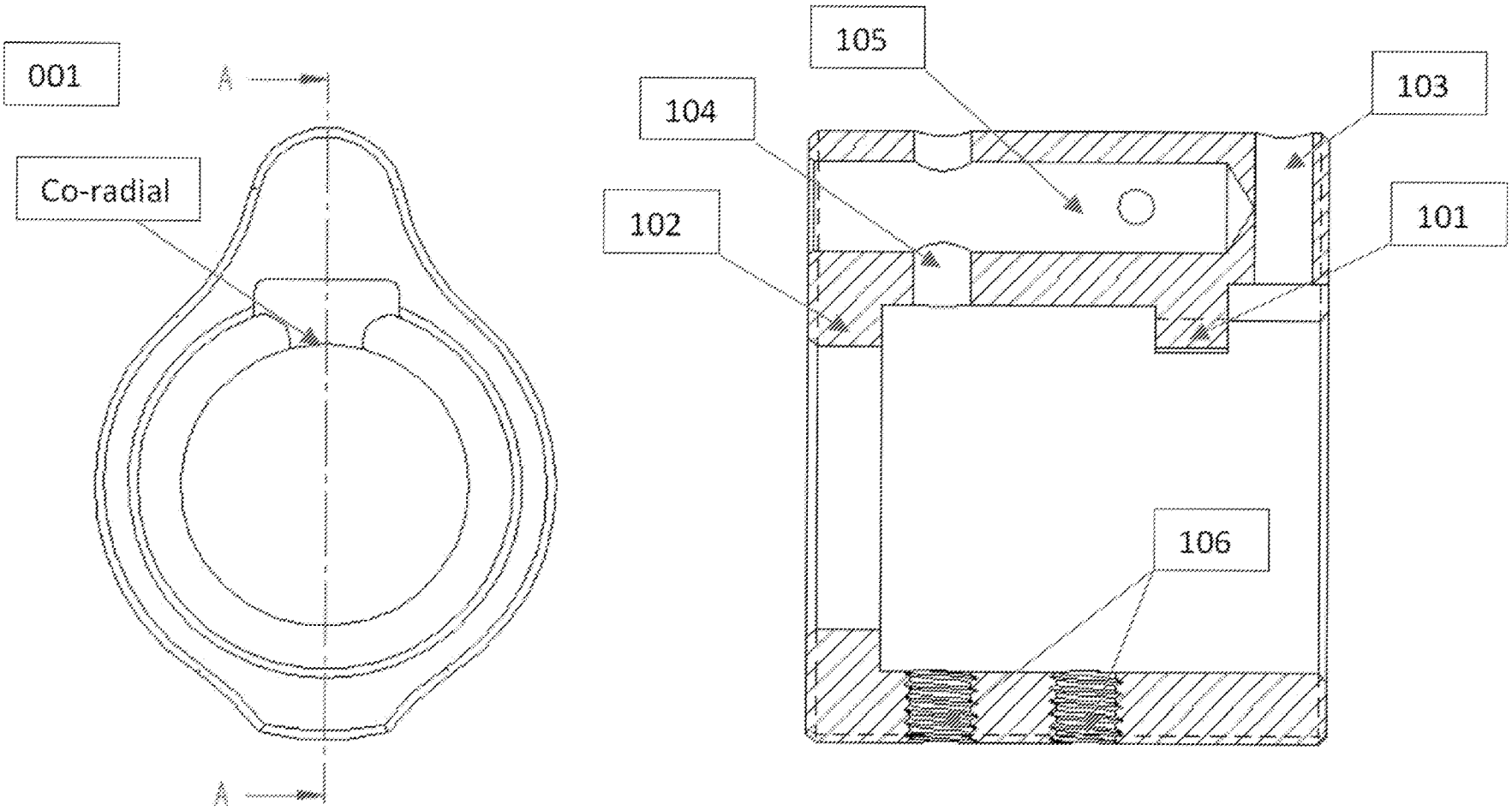
FIG. 2 is a diagram of cross-sectional views of a gas block body of an adjustable gas system in accordance with the present disclosure.

Under a proposed scheme in accordance with the present disclosure, Gas Block Body 001 (herein interchangeably referred to as "Gas Port Body 001") may be configured with a number of novel features described below. Referring to FIG. 2, Gas Block Body 001 may have a small gas block body bulge 101, formed on a first side (e.g., top side as shown in FIG. 2) an internal surface or wall of a cylindrically-shaped cavity or gas flow hole of Gas Block Body 001) that has a same radius tip as that of a ring 102 of Gas Block Body 001 at one end of the cylindrically-shaped cavity of Gas Block Body 001 (e.g., toward the left side in the cross-sectional view shown on the right side of FIG. 2), through which or where a gas port journal of a barrel of a firearm may reside. When Gas Block Body 001 is installed on the barrel of the firearm, both small gas block body bulge 101 and ring 102 may come in direct and physical contact with the barrel, while the barrel may be further secured by a force exerted by one or more set screw holes 106 on an opposite side (e.g., bottom side as shown in FIG. 2) of Gas Block Body 001. Moreover, Gas Block Body 001 may have a plunger cavity 103, a gas through hole 104, and a gas tube through hole 105. Plunger cavity 103 may be configured to house a plunger of the firearm. Gas through hole 104 may be configured to pass gas from the barrel to a gas tube of the firearm. Gas tube through hole 105 may be a cavity where the gas tube may reside.

Figure 3:
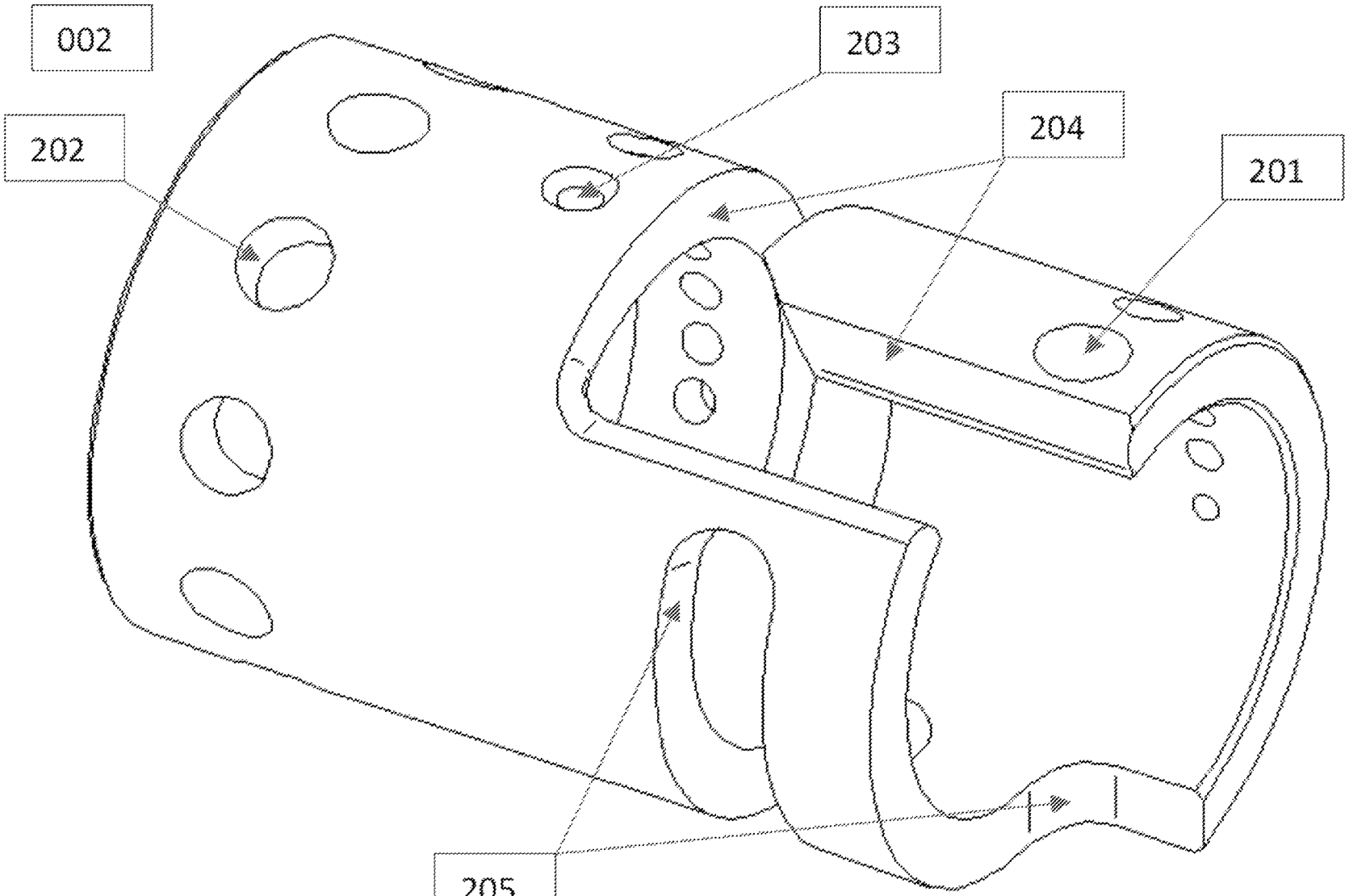
FIG. 3 is a diagram of a gas regulator in accordance with the present disclosure.

Under a proposed scheme in accordance with the present disclosure, referring to FIG. 3, Gas Regulator 002 may include a cylindrical body with multiple gas port holes 201 of different sizes (e.g., varying from a small size to a large size, and vice versa). Gas Regulator 002 may also include multiple grip assist holes 202, multiple allocation holes 203 for the plunger. Gas Regulator 002 may additionally include a clearance channel 204, both with an axial channel and a radial channel, configured to allow the gas regulator to pass through gas block body bulge 101 during the installation thereof, and then when letting the gas block body bulge 101 reach the radial section, such that gas block body bulge 101 can be guided to rotate along the clearance channel 204. Gas Regulator 002 may further include a clearance channel and cut out 205 configured to accommodate access to, as well as installation and removal of, the one or more set screw holes 106.

Figure 4:
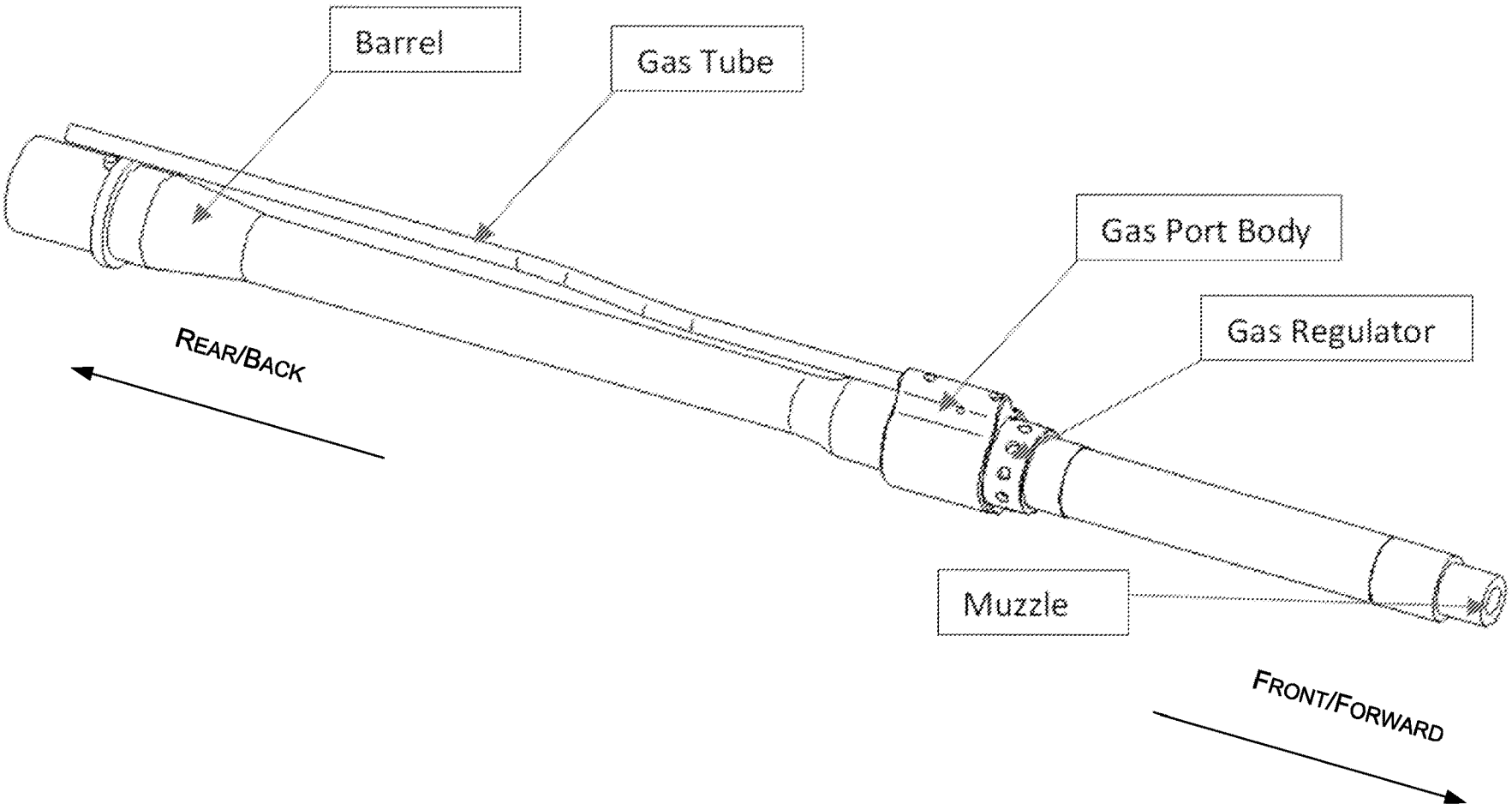
FIG. 4 is a diagram of a perspective view of an adjustable gas system implemented on a firearm barrel in accordance with the present disclosure.

FIG. 4 illustrates a perspective view of an adjustable gas system implemented on a firearm barrel in accordance with the present disclosure.

Highlights of Select Features

In one aspect, an adjustable gas system of a firearm may include a one-piece gas block body 001 configured to be clamped to a barrel of the firearm by: (i) one or more set screw holes 106 and (ii) direct and physical contact of a gas block body bulge 101 and a ring 102 at one end of the gas block body 001.

In some implementations, position of allocation hole 203 are correspond to the position of a size of the gas port through hole 201. When installed, the allocation hole can be aligned to the plunger 003 that installed on the gas block body 001, such that retaining the correspondent gas port through hole 201 line up with the gas port (not shown on the picture) on the barrel, as well as the gas though hole 104 on the gas block body 001. When change from one position of the allocation hole 203 to another, a different diameter of the gas port through hole 201 will line up between the barrel and the gas block body 001, hence regulate the gas flow amount.

In some implementations, when installed on the firearm, the gas regulator 002 may be retained inside the gas block body 001 and prevent the gas block body 001 from rotating to a position where the clearance channel 204 may line up with gas block body bulge 101. On the other hand, when the front (from the muzzle of the barrel) set screw of the set screw holes 106 is removed, the gas regulator 002 may be removed from the gas block body 001, while the back set screw of the set screw holes 106 may still keep or otherwise secure the gas block body 001 on the barrel. This means cleaning and maintenance work of the gas regulator can be performed, without uninstall the gas block body 001.

In some implementations, when installed on the firearm, the gas regulator 002 may be retained inside the gas block body 001 and prevent the gas block body 001 from rotating to a position where the clearance channel 204 may line up with gas block body bulge 101. On the other hand, when the front (from the muzzle of the barrel) set screw of the set screws 106 is removed, the gas regulator 002 may be removed from the gas block body 001, while the back set screw of the set screws 106 may still keep or otherwise secure the gas block body 001 on the barrel. This means cleaning and maintenance work of the gas regulator can be performed, without uninstall the gas port body.

CONCLUSION

It will be apparent to those skilled in the art that various modifications and variations can be made to the structure of the present disclosure without departing from the adjustable gas system or spirit of the present disclosure. Moreover, although examples given in the present disclosure are directed to firearms and usage of the proposed adjustable gas system for firearms, there is no limit on the applications of embodiments of the adjustable gas system disclosed herein. That is, any suitable implementation or application using an embodiment of the present disclosure, or variation thereof, is still within the scope of the present disclosure. In view of the foregoing, it is intended that the present disclosure cover modifications and variations of the present disclosure in view of the scope of the following claims and their equivalents.

What is claimed is:

1. An adjustable gas system for a firearm, comprising:

a one-piece gas block body configured to be fixed to a barrel of the firearm, the gas block body further comprising a gas block body bulge and a ring, the gas block body bulge being at one end of a barrel receiving cavity of the gas block body, the ring being at an opposite end of the barrel receiving cavity of the gas block body, the gas block body also comprising a gas tube through hole and a gas through hole that traverses the gas tube through hole and the barrel receiving cavity to allow gas to pass therethrough from the barrel of the firearm to the gas tube through hole, the gas tube through hole configured to receive a gas tube of the firearm, the gas block body configured to be clamped to the barrel of the firearm by:

one or more set screws, and direct physical contact of the gas block body bulge and the ring with the barrel of the firearm;

an annular gas regulator which, when installed on the barrel of the firearm, is configured to partially surround the barrel of the firearm such that the gas regulator is rotatable around the barrel from a first position to a second position, wherein the annular gas regulator comprises a plurality of gas port through holes, each having a different diameter, and a plurality of allocation holes, wherein one of the plurality of gas port through holes enables a first amount of gas to flow from the barrel of the firearm to the gas tube of the firearm when the annular gas regulator is in the first position, wherein another one of the plurality of gas port through holes enables a second amount of gas to flow from the barrel of the firearm to the gas tube of the firearm when the annular gas regulator is in the second position, wherein each of the plurality of allocation holes corresponds to a respective one of the plurality of gas port through holes, wherein the allocation holes interact with a plunger installed on the gas block body, wherein the plunger is retained in the gas block body by the gas regulator, wherein, when installed on the barrel of the firearm, the gas regulator is retained inside the barrel receiving cavity of the gas block body, thereby preventing the gas regulator from rotating to a position where a clearance channel of the gas regulator is lined up with the gas block body bulge, and wherein the one or more set screws comprise a front set screw and a back set screw, wherein, when the front set screw is removed from the gas block body, the gas regulator is removable from the gas block body, while the back set screw keeps the gas block body secured to the barrel.

* * * * *